US005160074A

United States Patent [19]

Coates

[11] Patent Number: 5,160,074

[45] Date of Patent: Nov. 3, 1992

[54] SKI SLING

[76] Inventor: Douglas L. Coates, 1311 W. Powell Rd., Cheyenne, Wyo. 82009

[21] Appl. No.: 760,090

[22] Filed: Sep. 16, 1991

[51] Int. Cl.[5] ..... A45F 3/14

[52] U.S. Cl. ..... 224/257; 224/917; 224/901; 294/147

[58] Field of Search ..... 224/257, 258, 917, 901; 294/147; 280/814

[56] References Cited

U.S. PATENT DOCUMENTS 3,960,302 6/1976 Mazzoni, Jr. ..... 224/257

4,114,838 9/1978 Knauf ..... 224/917

4,470,528 9/1984 Dyess ..... 224/917

*Primary Examiner*—Linda J. Sholl

[57] ABSTRACT

A ski carrying device comprised of a main carrying strap and VELCRO loop and hook fastening straps attached at each end to form a Y of the opposing components of said loop and hook fastening straps. The skis are inserted in the Y and the loop and hook fastening straps are lapped one over the other around the skis to securely hold them. By securing the skis above and below the bindings, the skis can then be carried over the shoulder or by using the sling as a handle. The carrier can be folded very compactly and stored in a pocket when not in use.

2 Claims, 1 Drawing Sheet

SKI SLING

SUMMARY OF THE INVENTION

This Invention relates to a simple ski carrying device to be used by an individual person to carry skis and can be folded compactly to be carried in a pocket when not in use.

Most ski carrying devices are too bulky to carry on one's person when not in use, they are too difficult for a child to operate, and they are designed to carry skis horizontally which is awkward and dangerous in crowds.

Therefore; an object of the Invention is to provide a ski carrying device which is very compact when not in use so that it can be carried easily on one's person, such as a pocket.

Another object of the Invention is to provide a ski carrying device which is so simple that even a child can easily put it on the skis and carry them.

Another object of the Invention is to provide a ski carrying device with which skis can be slung over the shoulder similar to a rifle and carried in a vertical position. The skis can easily be dismounted from one's shoulder with a minimum of interference with nearby objects and people.

Another object of the Invention is to provide a ski carrying device which can be left installed on the skis when placed in a gondola ski rack, bus ski rack, airplane, commercial bus or ski rack or other storage areas. The skis can then be retrieved with the ski carrying device already installed for immediate use.

Another object of the Invention is to keep the manufacture of the same as simple and inexpensive as possible The ski carrying device of the present Invention is comprised of a strap of nylon, polyester, leather or other similar strong, supple material with VELCRO loop and hook fastening strips at both ends in a Y configuration to wrap around the skis, firmly securing them. The skis can then be carried by using the strap as a handle or sling.

DETAILED DESCRIPTION OF THE PREFERRED EMBODIMENT

Figure 1:
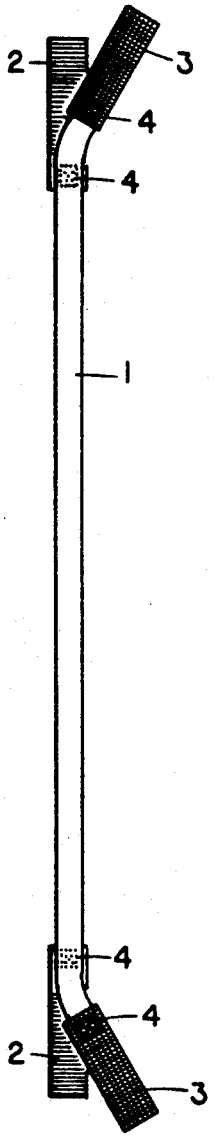
FIG. 1 is a front elevational view of the ski carrying device of the present Invention.

Referring to the drawings, one embodiment of the ski carrying device according to the present Invention is comprised of a strap 1, which will be used as sling over the shoulder or as a handle with which to carry the skis. The applicant has found that a strap approximately one inch wide functions satisfactorily. The strap can be nylon, polyester, leather or other material with similar strength and flex qualities. The strap can have any combination of color, design, monograms or artwork embodied on it.

At the very ends of strap 1, a strap of the loop side of VELCRO loop and hook fastening strap 3 is attached by sewing, riveting or similar form of permanent attachment. Just below VELCRO loop and hook fastening strap 3, a strap of the hook side of VELCRO loop and hook fastening strap 2 is attached in a similar manner on the opposite side of strap 1 to form a Y of VELCRO loop and hook fastening straps at the ends of strap 1.

Figure 2:
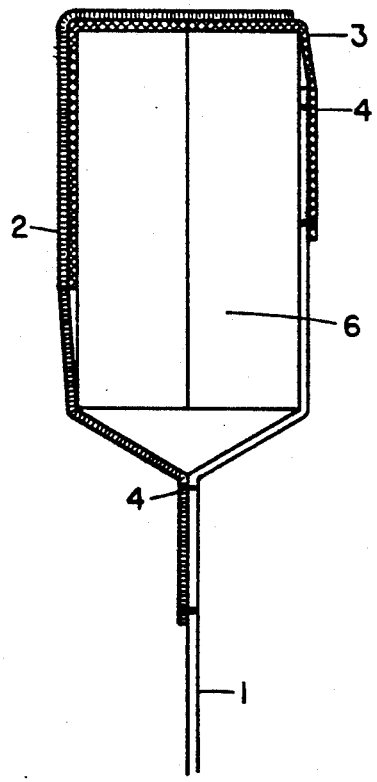
FIG. 2 is a sectional view of either end of the ski carrying device of the present Invention.

Referring to FIG. 2, the VELCRO loop and hook fastening strap 3 is wrapped around the skis 6, then the VELCRO loop and hook fastening strap 2 is wrapped around the skis 6 over VELCRO loop and hook fastening strap 3, thus securely fastening the ski carrying device of the present Invention to the skis 6.

Figure 3:
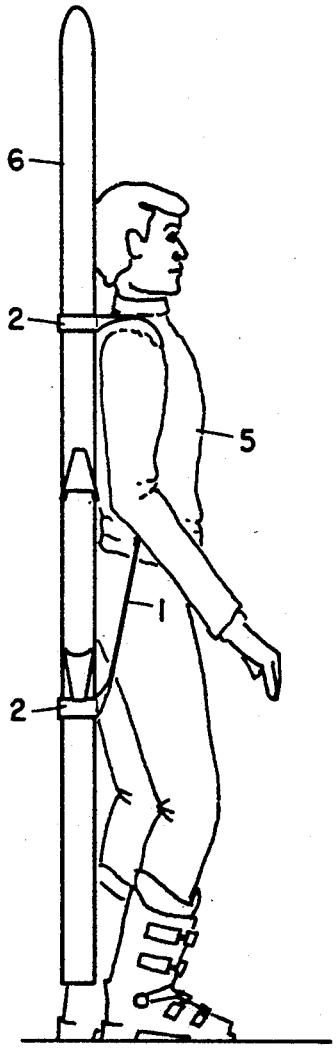
FIG. 3 is a side elevational view of the ski carrying device in use to sling skis over a person's shoulder.

Referring to FIG. 3, the ski carrying device of the present Invention has one end attached above the ski binding toe pieces and the other end attached below the ski binding heel pieces. This arrangement also keeps the skis balanced if the skis are held horizontally with the ski sling used as a handle. Other methods of attachment may be made such as above and below the toe pieces. No adjustment of the strap length is required as the straps slide to a natural position on the skis. A standard length strap of approximately 30 inches between VELCRO loop and hook fastening straps fits all lengths of skis and sizes of skiers although a shorter length is better for very small children.

The present Invention is no intended to be limited to the embodiment described in the foregoing, but also contemplates other embodiments which are within the scope and spirit of the Invention as defined in the attached claims.

What I claim is:

1. A ski carrying device and a pair of skis comprising:

a pair of skis;

an elongated carrying strap having an elongated length with a first end and a second end and sized to be carried over a shoulder of a user;

first and second fastening straps formed of either loop or hook fastening material and being secured to said first and second ends respectively; said first and second fastening straps extending beyond said first and second ends with an elongated length of said first and second fastening straps coextending with said elongated length of said elongated carrying strap;

third and fourth fastening straps formed of either loop or hook fastening material and being opposite of that of said first and second fastening straps; said third and fourth fastening straps secured near the first and second ends of said elongated carrying strap respectively at points spaced away from the securement points of said first and second fastening straps and said elongated carrying strap; said third and fourth fastening straps having an elongated length with one end secured to the elongated carrying strap and being parallel with said elongated length of said elongated carrying strap; said third and fourth fastening straps extending in the same direction as said first and second fastening straps to form a Y-shape at the first and second ends of the elongated carrying strap;

said skis having bottoms positioned next to each other and said skis positioned inbetween the first and third fastening straps at one end and the second and fourth fastening straps at the other end; said first and second fastening straps extending around said skis with said third and fourth fastening straps extending around said skis in the opposite direction to overlap each other; and said first and third straps and said second and fourth straps being secured together by the loop and hook fastening material.

2. A ski carrying device defined in claim 1 which can be folded to a very compact, flexible size of 1 inch×1 inch×4½ inches (4.5 cubic inches) or less.

* * * * *